US007401664B2

(12) United States Patent
Wells et al.

(10) Patent No.: US 7,401,664 B2
(45) Date of Patent: Jul. 22, 2008

(54) TOP DRIVE SYSTEMS

(75) Inventors: Lawrence E. Wells, Yorba Linda, CA (US); Preston Fox, Fountain Valley, CA (US); Cliff Swiontek, Brea, CA (US); Svein Stubstad, Houston, TX (US)

(73) Assignee: Varco I/P, Houston, TX (US)

( * ) Notice: Subject to any disclaimer, the term of this patent is extended or adjusted under 35 U.S.C. 154(b) by 274 days.

(21) Appl. No.: 11/414,512

(22) Filed: Apr. 28, 2006

(65) Prior Publication Data

US 2007/0251699 A1 Nov. 1, 2007

(51) Int. Cl.
*E21B 19/00* (2006.01)

(52) U.S. Cl. ..... 175/52; 166/77.51; 175/85

(58) Field of Classification Search ..... 175/52, 175/85, 122; 166/77.51
See application file for complete search history.

(56) References Cited

U.S. PATENT DOCUMENTS

| | | | | |
|---|---|---|---|---|
| 2,589,119 | A | 3/1952 | O'Leary | |
| 2,998,084 | A | 8/1961 | Johnson et al. | |
| 4,010,600 | A | 3/1977 | Poole et al. | 57/129 |
| 4,115,911 | A | 9/1978 | Poole et al. | 29/402.12 |
| 4,205,423 | A | 6/1980 | Poole et al. | 29/402.11 |
| 4,421,179 | A | 12/1983 | Boyadjieff | 173/44 |
| 4,449,596 | A | 5/1984 | Boyadjieff | 175/85 |
| 4,458,768 | A | 7/1984 | Boyadjieff | 175/85 |
| 4,529,045 | A | 7/1985 | Boyadjieff et al. | 173/164 |
| 4,589,503 | A | 5/1986 | Johnson et al. | 175/113 |
| 4,605,077 | A | 8/1986 | Boyadjieff | 175/85 |
| 4,753,300 | A | 6/1988 | Shaw et al. | 173/164 |
| 4,759,239 | A | 7/1988 | Hamilton et al. | 81/57.34 |
| 4,793,422 | A | 12/1988 | Krasnov | 175/57 |
| 4,800,968 | A | 1/1989 | Shaw et al. | 175/85 |
| 4,813,493 | A | 3/1989 | Shaw et al. | 173/164 |
| 4,854,383 | A | 8/1989 | Arnold et al. | 166/70 |
| 4,865,135 | A | 9/1989 | Moses | 175/57 |
| 4,878,546 | A | 11/1989 | Shaw et al. | 173/163 |
| 4,899,832 | A | 2/1990 | Bierscheid, Jr. | 173/23 |
| 5,038,871 | A | 8/1991 | Dinsdale | 175/52 |
| 5,107,940 | A | 4/1992 | Berry | 175/85 |
| 5,251,709 | A | 10/1993 | Richardson | 175/220 |
| 5,255,751 | A | 10/1993 | Stogner | 175/203 |
| 5,381,867 | A | 1/1995 | Berry | 175/85 |
| 5,388,651 | A | 2/1995 | Berry | 175/85 |
| 5,433,279 | A | 7/1995 | Tessari et al. | 173/213 |
| 5,501,286 | A | 3/1996 | Berry | 175/52 |

(Continued)

FOREIGN PATENT DOCUMENTS

| | | |
|---|---|---|
| GB | 2 228 025 | 8/1990 |

OTHER PUBLICATIONS

An Overview of Top-Drive Drilling Systems Applications and Experiences, G. I. Boyadjieff. IADC/SPE 14716, 8 pp. 1986.

(Continued)

*Primary Examiner*—William P Neuder
(74) *Attorney, Agent, or Firm*—Guy McClung

(57) ABSTRACT

A top drive system for wellbore operations, the top drive system including motor apparatus, a main shaft driven by the motor apparatus, the main shaft having a top end and a bottom end, a quill connected to the main shaft, and a gear system interconnected with the quill and the motor apparatus.

20 Claims, 11 Drawing Sheets

U.S. PATENT DOCUMENTS

| | | | | |
|---|---|---|---|---|
| 5,755,296 | A | 5/1998 | Richardson et al. | 175/162 |
| 6,024,181 | A | 2/2000 | Richardson et al. | 175/162 |
| 6,276,450 | B1 | 8/2001 | Seneviratne | 166/85.1 |
| 6,527,047 | B1 | 3/2003 | Pietras | 166/77.51 |
| 6,536,520 | B1 | 3/2003 | Snider et al. | 166/78.1 |
| 6,551,034 | B1 * | 4/2003 | Nyhuis et al. | 408/129 |
| 6,622,796 | B1 | 9/2003 | Pietras | 166/379 |
| 6,679,333 | B2 | 1/2004 | York et al. | 166/379 |
| 6,688,398 | B2 | 2/2004 | Pietras | 166/380 |
| 6,705,405 | B1 | 3/2004 | Pietras | 166/380 |
| 6,725,938 | B1 | 4/2004 | Pietras | 166/380 |
| 6,725,949 | B2 | 4/2004 | Seneviratne | 175/85 |
| 6,742,596 | B2 | 6/2004 | Haugen | 166/380 |
| 6,913,096 | B1 * | 7/2005 | Nielsen et al. | 175/85 |
| 6,935,440 | B2 | 8/2005 | Nelson et al. | 175/52 |
| 6,951,082 | B2 | 10/2005 | Nelson et al. | 52/112 |
| 6,973,979 | B2 | 12/2005 | Carriere et al. | 175/203 |
| 6,994,176 | B2 | 2/2006 | Shahin et al. | 175/423 |
| 7,007,753 | B2 | 3/2006 | Robichaux et al. | 166/291 |
| 7,231,969 | B2 * | 6/2007 | Folk et al. | 166/77.51 |
| 7,270,189 | B2 * | 9/2007 | Brown et al. | 166/380 |
| 2002/0134555 | A1 | 9/2002 | Allen et al. | 166/377 |
| 2003/0221519 | A1 | 12/2003 | Haugen | 81/57.15 |

OTHER PUBLICATIONS

Varco Pioneers AC Top Drive, Engineering Award Winners. AC Top Drive Technology Update #1. Hart's Petroleum Engineer. 4 pp. Apr. 1997.

AC Top Drive Technology Update #2. Varco Systems. 1 p. Prior to 2002.

Top Drive Drilling System TD 500 PAC Variable Frequency AC Top Drive, National Oilwell, 6 pp., 2002.

1000 Ton AC Top Drive—TDS—1000, Varco Systems, 2 pp., 2002.

750 Ton DC Top Drive TDS—45. Varco Systems, 2 pp., 2002.

500 Ton DC Top Drive IDS—1, Varco Systems. 2 pp., 2002.

Varco's Top Drive Systems are advancing the technology of drilling, Varco Systems, 8 pp., 2001.

Hydraulic Top Drive: West Coast Int'l BV: 6 pp.: 2006.

Portable Top Drive PTD: 2 Maritime Hydraulics: 2 pp.: 2005.

Top Drive Drilling System: Varco BJ: 4 pp.: 1993.

General Catalogue 2005: Maritime Hydraulics: 6 pp.: 2005.

* cited by examiner

TOP DRIVE SYSTEMS

BACKGROUND OF THE INVENTION

1. Field Of The Invention

This invention is directed to wellbore drilling top drive systems; parts thereof; and methods of their use.

2. Description of Related Art

The prior art discloses a variety of top drive systems; for example, and not by way of limitation, the following U.S. Patents present exemplary top drive systems and components thereof: U.S. Pat. Nos. 4,458,768; 4,807,890; 4,984,641; 5,433,279; 6,276,450; 4,813,493; 6,705,405; 4,800,968; 4,878,546; 4,872,577; 4,753,300; 6,007,105; 6,536,520; 6,679,333; 6,923,254 —all these patents incorporated fully herein for all purposes.

Certain typical prior art top drive drilling systems have a derrick supporting a top drive which rotates tubulars, e.g., drill pipe. The top drive is supported from a travelling block beneath a crown block. A drawworks on a rig floor raises and lowers the top drive. The top drive moves on a guide track.

BRIEF SUMMARY OF THE INVENTION

The present invention, in certain aspects, provides a top drive system for wellbore operations, the top drive system including: a main body; a motor apparatus (e.g. one motor, or two spaced-apart motors); a main shaft extending from the main body, the main shaft having a top end and a bottom end, the main shaft having a main shaft flow bore therethrough from top to bottom through which drilling fluid is flowable; a quill connected to and around the main shaft; a gear system interconnected with the quill, the gear system driven by the motor apparatus so that driving the gear system drives the quill and thereby drives the main shaft; upper components connected to the main body above the top end of the main shaft; and the main shaft removable from the top drive system by disconnecting the main shaft from the quill, by disconnecting the upper components from the main body, and by lifting the main shaft from the quill. In certain aspects such removal of the main shaft is done without any lubricant being lost from an enclosed space containing the gear system.

In one aspect, the present invention discloses a method for removing a main shaft from a top drive system, the method including: disconnecting the main shaft from a quill of the top drive system, the top drive system having a main body, a motor apparatus, a main shaft extending from the main body, the main shaft having a top end and a bottom end, the main shaft having a main shaft flow bore therethrough from top to bottom through which drilling fluid is flowable, a quill connected to and around the main shaft (the quill being a generally hollow cylindrical member or shaft), a gear system interconnected with the quill, the gear system driven by the motor apparatus so that driving the gear system drives the quill and thereby drives the main shaft, the main shaft passing through the gear system, upper components connected to the main body above the top end of the main shaft, the main shaft removable from the top drive system by disconnecting the main shaft from the quill, by disconnecting the upper components from the main body and moving the upper components from above the main shaft, and by lifting the main shaft from the quill; disconnecting the upper components from the main body; and lifting the main shaft from the quill. In certain aspects of the method wherein the gear system is in lubricant within an enclosed space and the main shaft is removed without loss of lubricant from the enclosed space.

It is, therefore, an object of at least certain preferred embodiments of the present invention to provide:

New, useful, unique, efficient, non-obvious top drive systems, components and parts thereof, and methods of their use;

Such systems with an effective main-shaft/quill connection;

Such systems with a removable main shaft; and

Such systems with two supporting bails.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, various purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later attempt to disguise it by variations in form or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

DETAILED DESCRIPTION OF THE INVENTION

Figure 1:
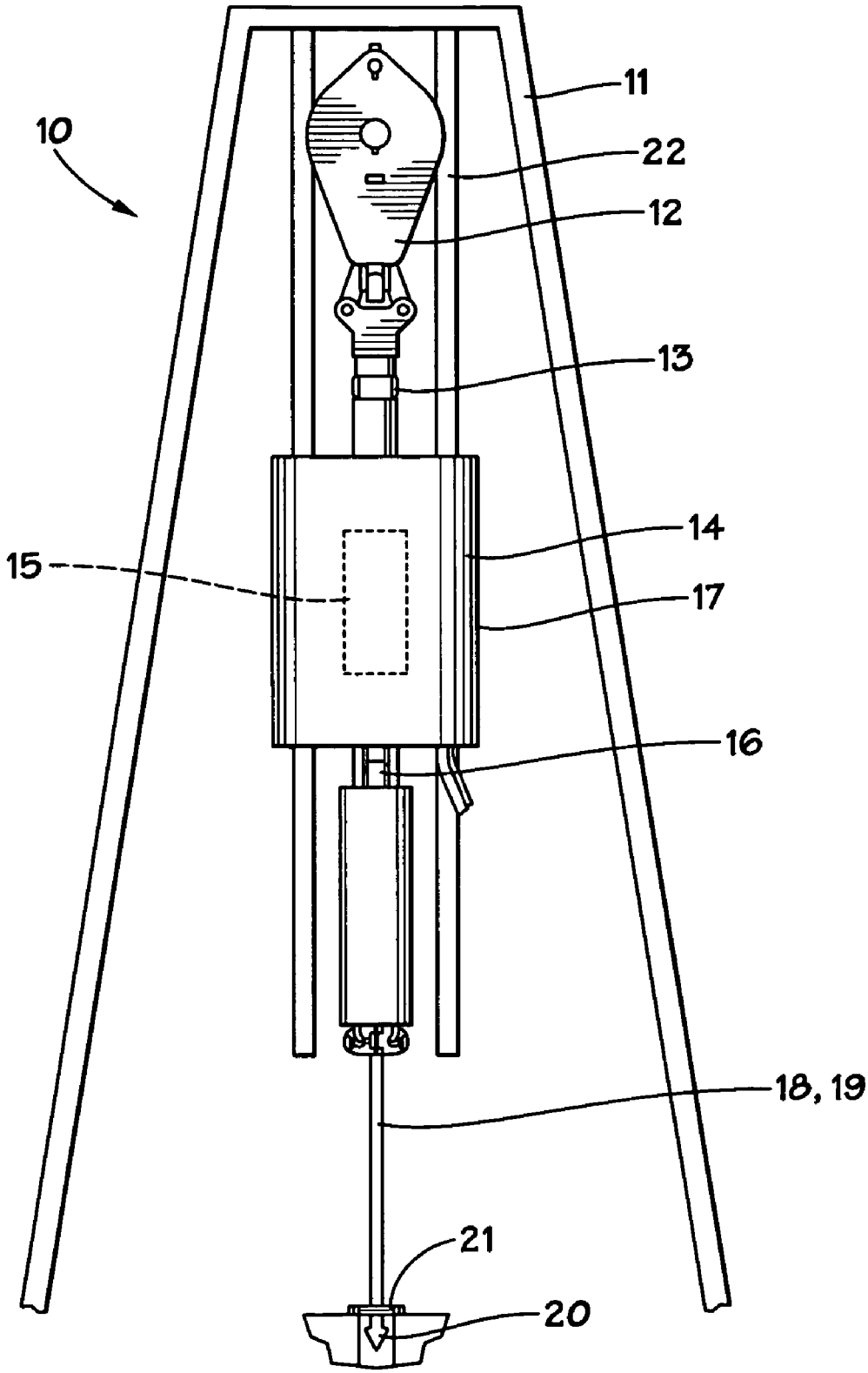
FIG. 1 is a schematic view of a top drive drilling system according to the present invention.
Figure 2B:
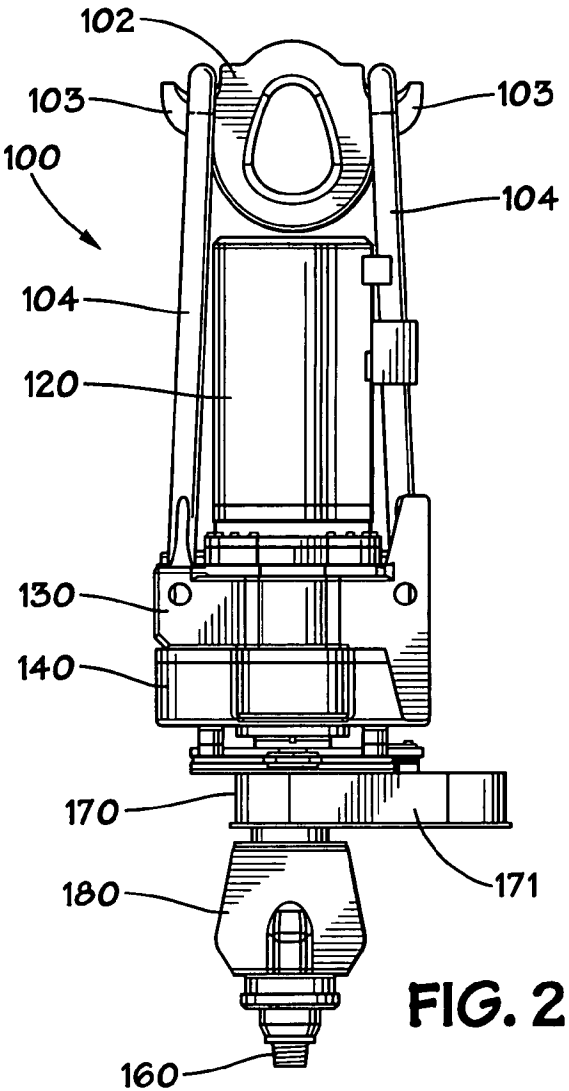
FIG. 2B is a side view of a top drive system according to the present invention.
Figure 2A:
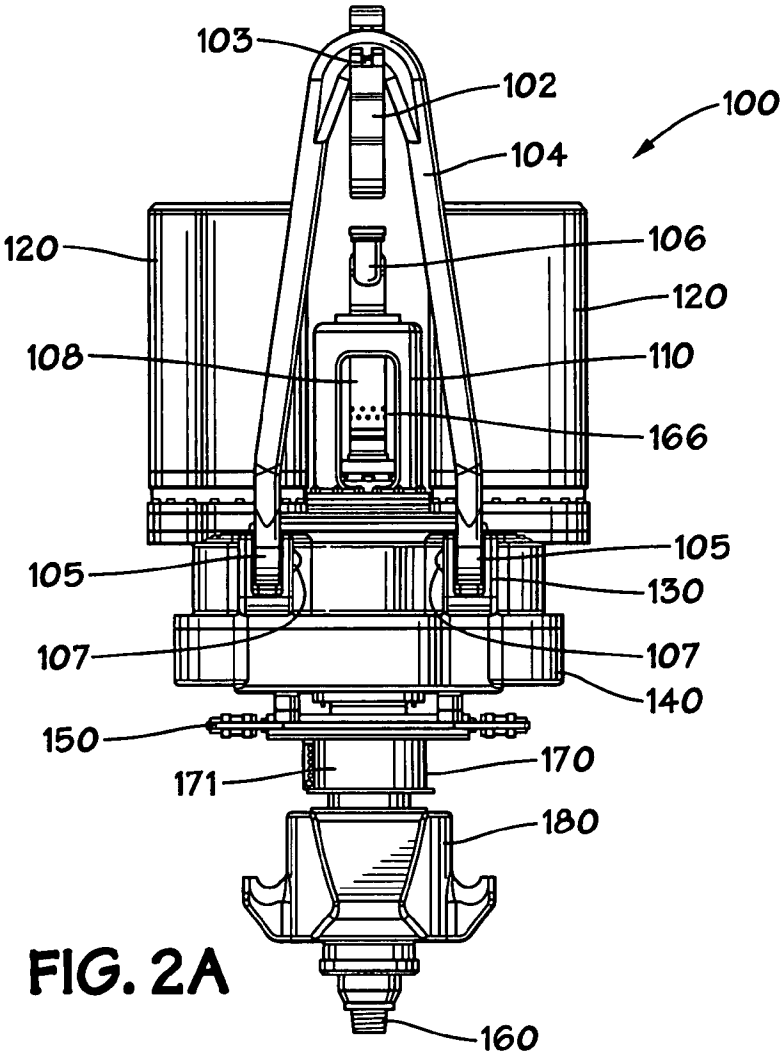
FIG. 2A is a front view of a top drive system according to the present invention.
Figure 2C:
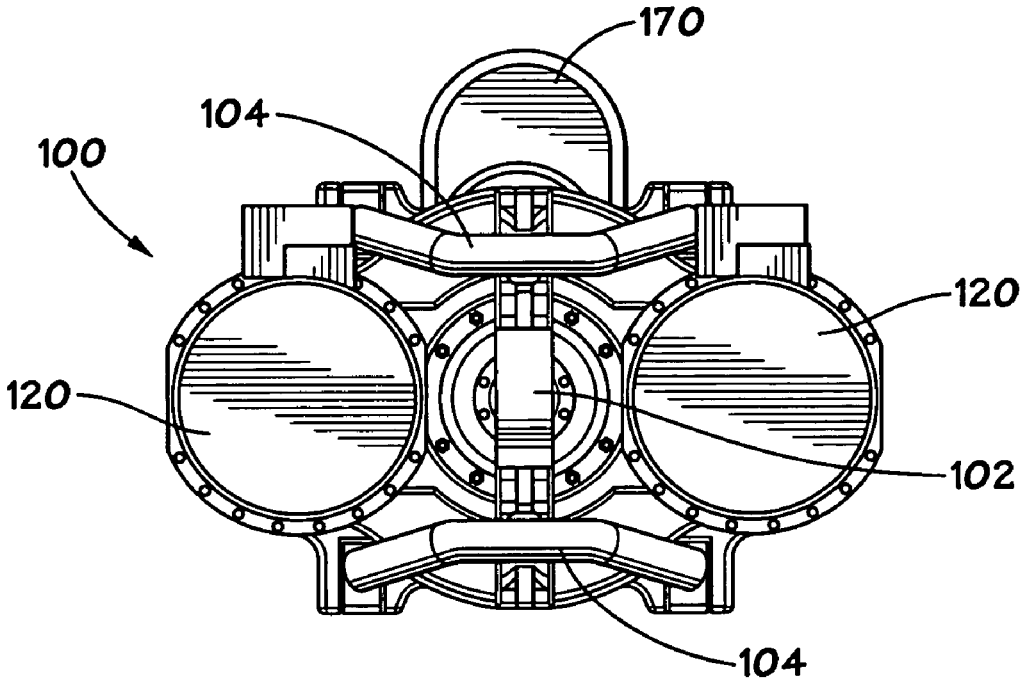
FIG. 2C is a top view of the top drive system of FIG. 2A.

FIG. 1 illustrates a top drive system according to the present invention which is structurally supported by a derrick 11. The system 10 has a plurality of components including: a swivel 13, a top drive 14 according to the present invention (any disclosed herein), a main shaft 16, a housing 17, a drill stem 18/drillstring 19 and a drill bit 20. The components are collectively suspended from a traveling block 12 that allows them to move upwardly and downwardly on rails 22 connected to the derrick 11 for guiding the vertical motion of the components. Torque generated during operations with the top drive or its components (e.g. during drilling) is transmitted through a dolly to the derrick 11. The main shaft 16 extends through the motor housing 17 and connects to the drill stem 18. The drill stem 18 is typically threadedly connected to one end of a series of tubular members collectively referred to as the drillstring 19. An opposite end of the drillstring 19 is threadedly connected to a drill bit 20.

During operation, a motor apparatus 15 (shown schematically) encased within the housing 17 rotates the main shaft 16 which, in turn, rotates the drill stem 18/drillstring 19 and the drill bit 20. Rotation of the drill bit 20 produces an earth bore 21. Fluid pumped into the top drive system passes through the main shaft 16, the drill stem 18/drillstring 19, the drill bit 20 and enters the bottom of the earth bore 21. Cuttings removed by the drill bit 20 are cleared from the bottom of the earth bore 21 as the pumped fluid passes out of the earth bore 21 up through an annulus formed by the outer surface of the drill bit 20 and the walls of the bore 21.

FIGS. 2A-2G illustrate a top drive system 100 according to the present invention (which may be used as the top drive system 10, FIG. 1) which has supporting bails 104 suspended from a becket 102. Motors 120 which rotate a main shaft 160 are supported on a main body 130. A bonnet 110 supports a gooseneck 106 and a washpipe 108 through which fluid is pumped to and through the system 100 and through a flow channel 163 through the main shaft 160. Within the bonnet 110 are an upper packing box 115 (connected to the gooseneck 106) for the washpipe 108; and a lower packing box 117 for the washpipe 108.

A main gear housing 140 encloses a bull gear 142 and other associated components as described in detail below.

A ring gear housing 150 encloses a ring gear 152 and associated components as described in detail below.

A drag chain system 170 encloses a drag chain 172 and associated components including hoses and cables as described below. This drag chain system 170 eliminates the need for a rotating head used in several prior systems and provides sufficient rotation for reorientation of the link adapter 180 and items connected thereto.

Figure 3A:
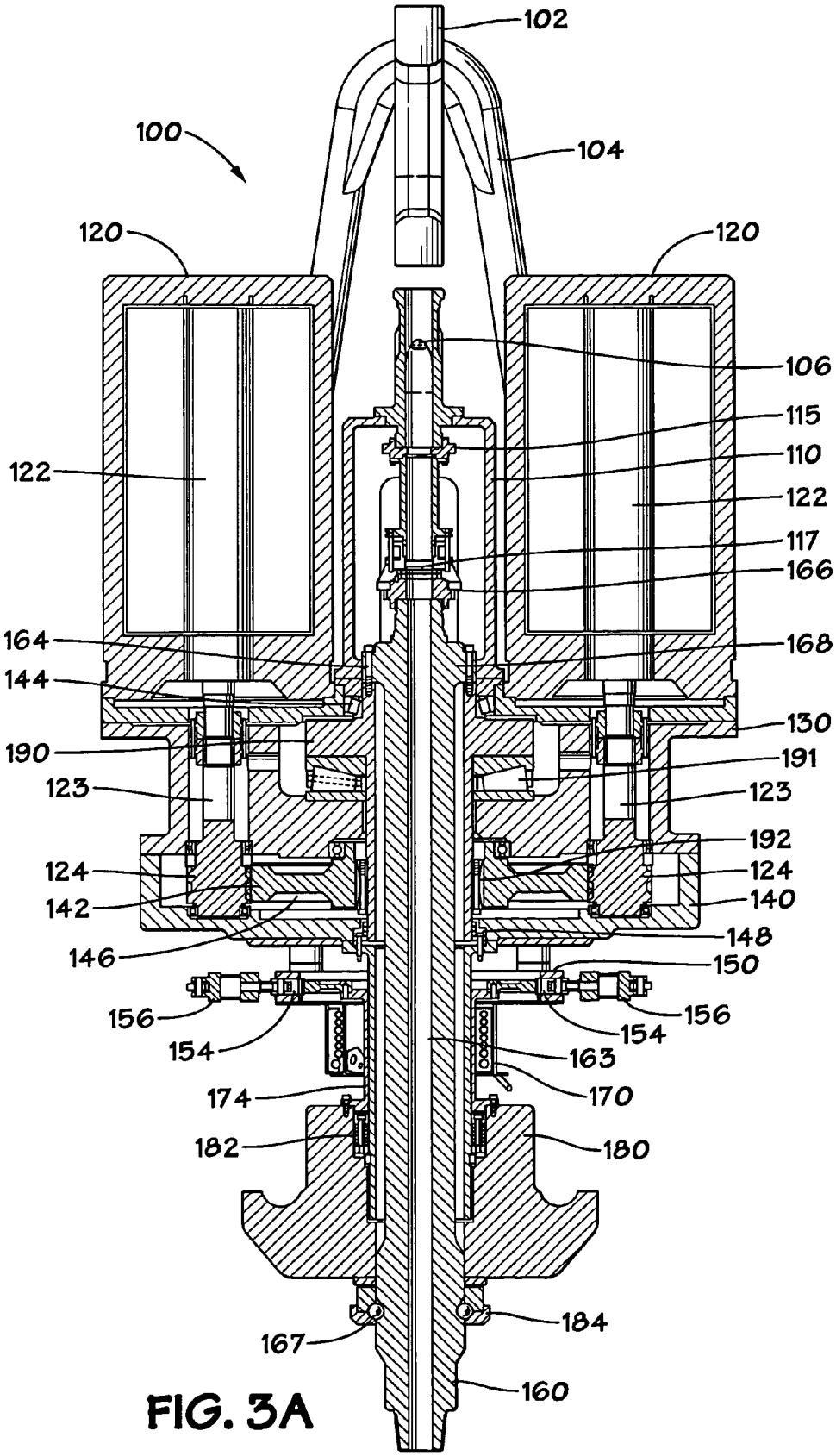
FIG. 3A is a front cross-section view of the top drive system of FIG. 2A.

Bolts 112 (see FIGS. 2E and 2F) releasably secure the bonnet 110 to the body 130. Removal of the bolts 112 permits removal of the bonnet 110. Bolts 164 through a load shoulder 168 releasably secure the main shaft 160 to a quill 190 (see FIG. 3A). The quill 190 is a transfer member between the main shaft 160 and the bull gear 142 and transfers torque between the bull gear 142 and the main shaft 160. The quill 190 also transfers the tension of a tubular or string load on the main shaft to the thrust bearings 191 (not to the bull gear 142). The transfer of torque between the main shaft 160 and the quill 190 is effected with a plurality of spaced apart expandable tapered screw-in torque transfer bushings 159 which, in certain aspects, reduce or eliminate play between the main shaft 160 and the quill 190. An end 160*a* of the main shaft 160 (see FIG. 2F) is referred to as the "washpipe end." One or more seal retainer bushings 166 (shown schematically, FIG. 2A) are located above the load shoulder 168. As described in detail below, removal of the bonnet 110 and bolts through the load shoulder 168 securing the main shaft 160 to a quill 190, permits removal of the main shaft 160 from the system 100. Upper quill bearings 144 are above a portion of the quill 190.

Figure 2D:
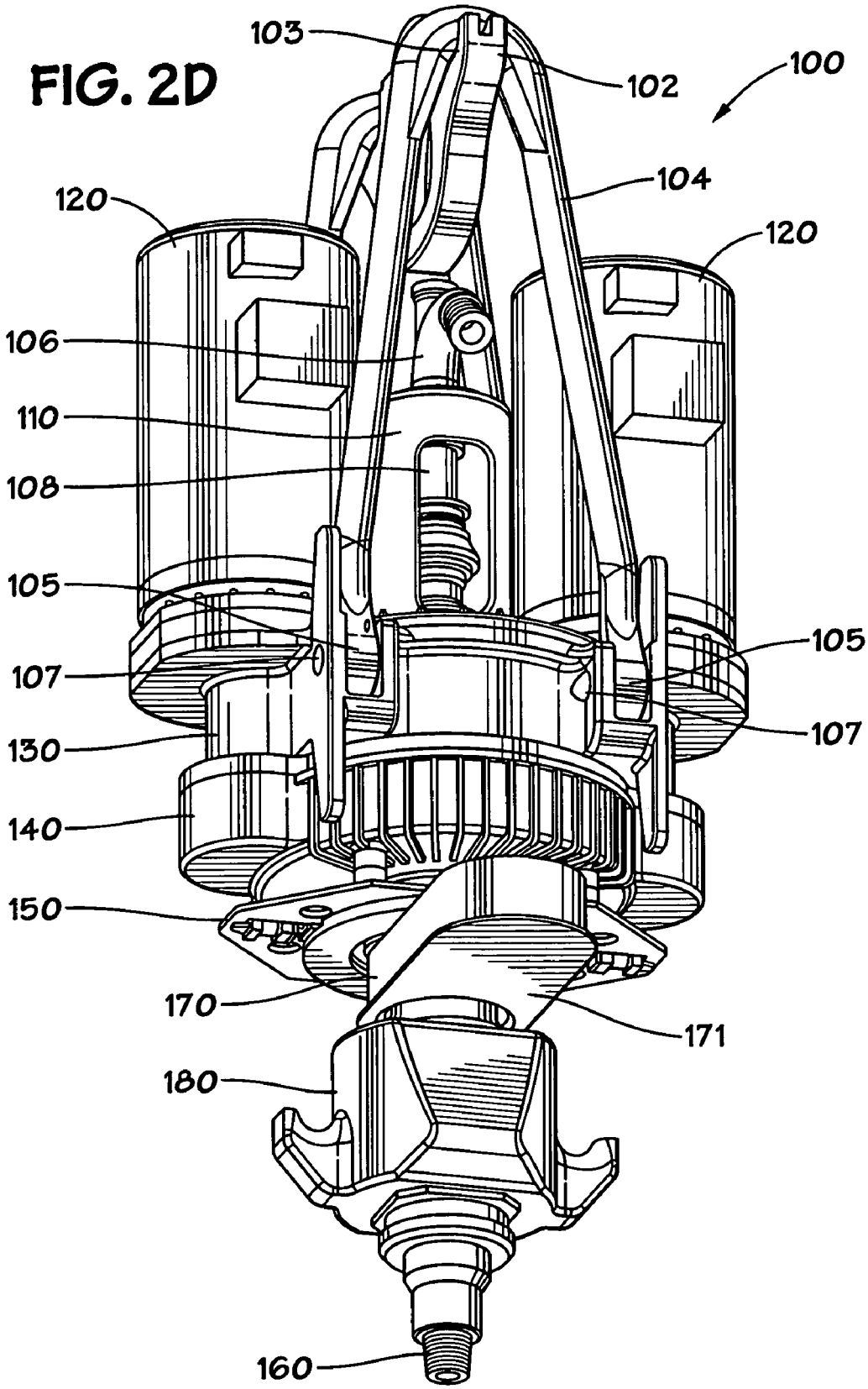
FIG. 2D is a rear isometric view of FIG. 2A.
Figure 2E:
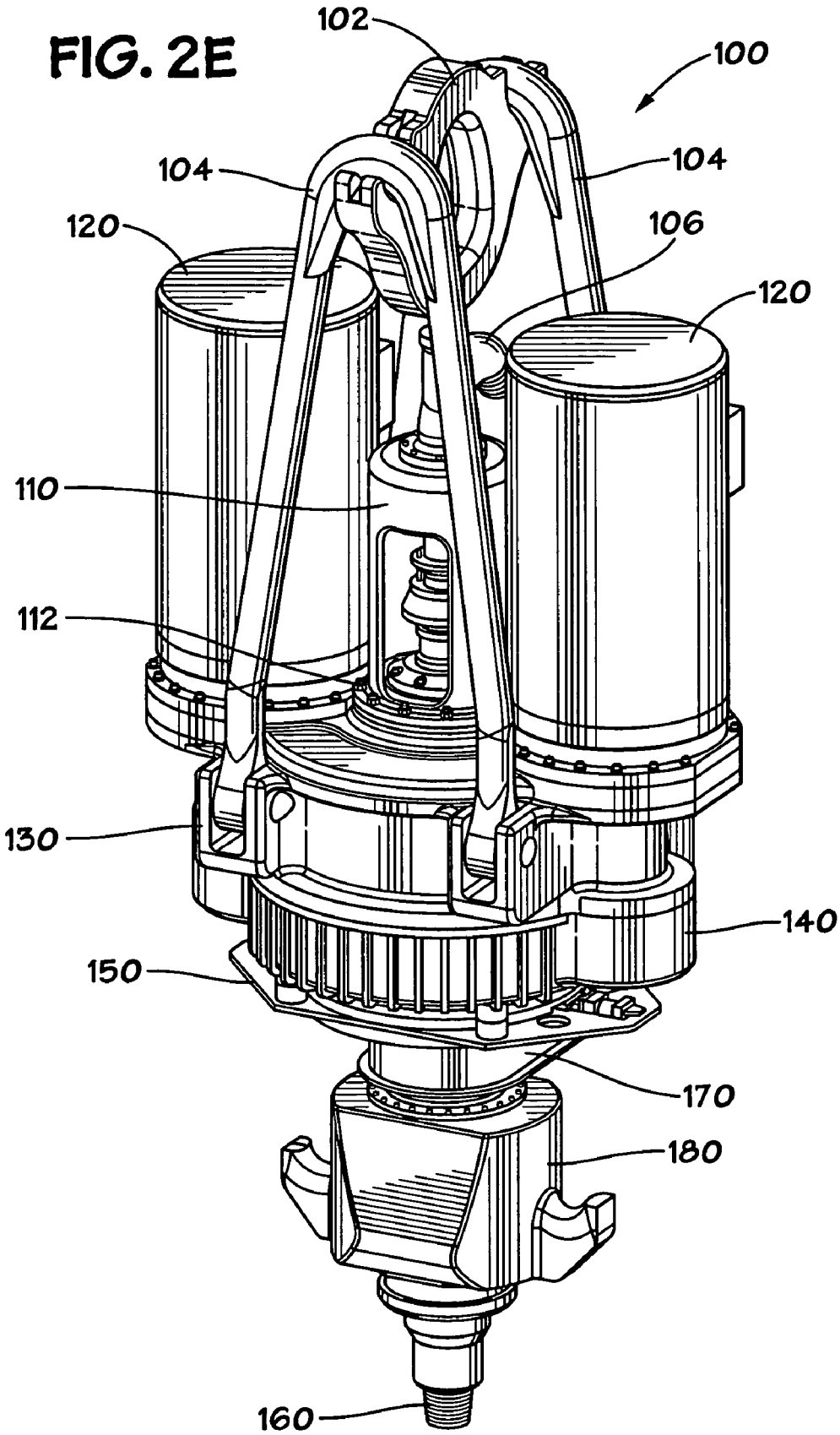
FIG. 2E is a front isometric view of FIG. 2A.
Figure 2F:
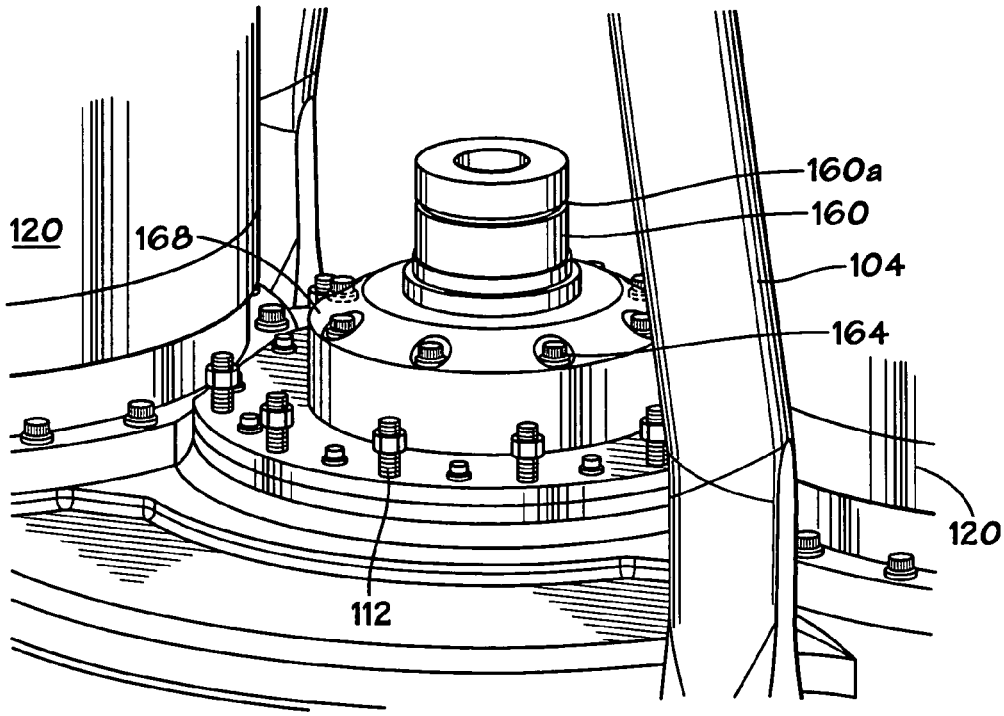
FIG. 2F is a front isometric view of part of FIG. 2A.
Figure 2G:
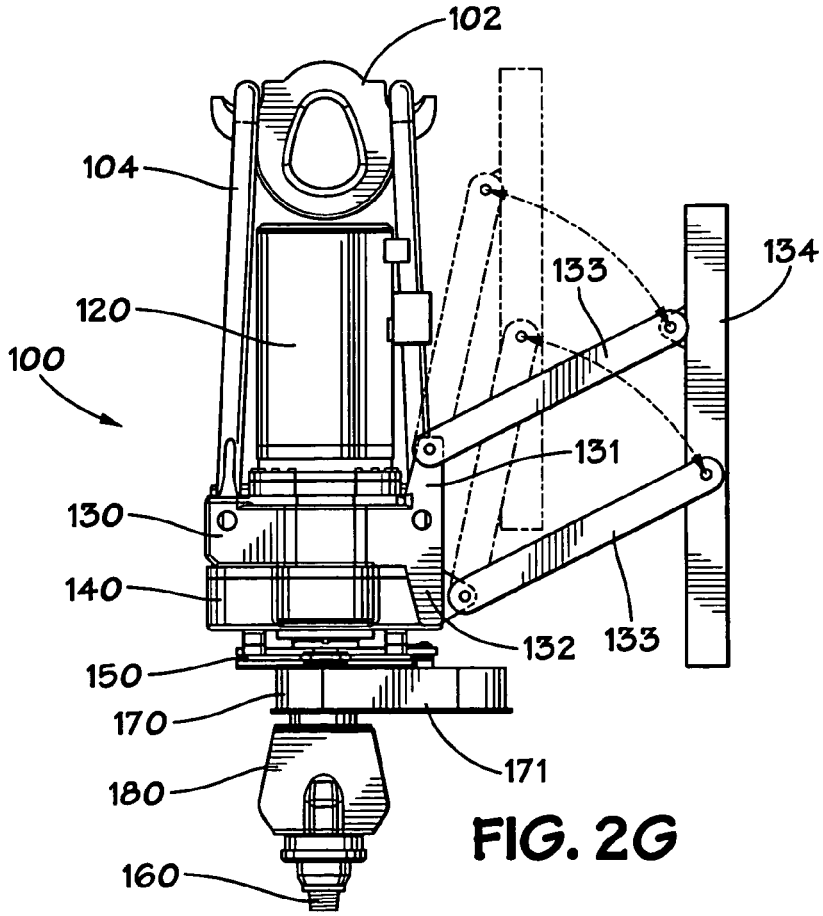
FIG. 2G is a side view of the top drive system of FIG. 2A connected to a dolly.

As shown in FIG. 2G, the system 100 is movable on a mast or part of a derrick (like the derrick 11 and on its rails 22) by connection to a movable apparatus like the dolly 134 (FIG. 2G). Ends of links 133 are pivotably connected to arms 131, 132 of the body 130. The other ends of the links 133 are pivotably connected to the dolly 134. This structure permits the top drive and associated components to be moved up and down, and toward and away from a well centerline, as shown by the structure in dotted line (toward the derrick when drill pipe is connected/disconnected while tripping; and to the well center during drilling). Known apparatuses and structures are used to move the links 133 and to move the dolly 134.

Upper parts of the bails 104 extend over and are supported by arms 103 of the becket 102. Each bail 104 has two spaced-apart lower ends 105 pivotably connected by pins 107 to the body 130. Such a use of two bails distributes the support load on the main body and provides a four-point support for this load, economically reducing bending moments on the main body.

The quill 190 (see FIG. 3A) rests on main thrust bearings 191 which support the quill 190, the main shaft 160, and whatever is connected to the main shaft 160 (including whatever load is borne by the main shaft 190 during operations, e.g. drilling loads and tripping loads). The body 130 houses the main thrust bearings 191 and contains lubricant for the main thrust bearings 191. An annular passage 145 (see FIG. 3C) provides a flow path for lubricant from the gear housing 140 to the thrust bearings.

Shafts 122 of the motors 120 drive drive couplings 123 rotatably mounted in the body 130 which drive drive pinions 124 in the main gear housing 140. The drive pinions 124 drive a bull gear 142 which, connected to the quill 190 with connectors 192 (e.g., but not limited to, taper lock connectors in which turning bolts 193 ((see FIG. 3D)) tightens the connectors screwing together parts 194 which push the parts 194 against the quill 190 and which push out wedges 195 against the bull gear 142 securing the bull gear 142 to the quill 190), drives the quill 190 and thus the main shaft 160 which is connected to the quill 190. Radial bearings 197 support the bull gear 142.

The bull gear 142 is within a lower portion 146 of the gear housing 140 which holds lubricant for the bull gear 142 and is sealed with seal apparatus 148 so that the lubricant does not flow out and down from the gear housing 140. Any suitable known rotary seal 148 may be used or, as in one particular aspect the seal apparatus 148 is like the seal apparatus disclosed in co-owned U.S. application Ser. No. filed on even date herewith entitled "Multi-Seal For Top Drive Shaft", which is incorporated fully herein for all purposes. With such a seal apparatus, which has rotatable bolts 149, when a first seal structure no longer seals effectively, the bolts 149 are rotated and a second seal structure is shifted into place to effect a good seal. Within the gear housing 140, the bull gear 142 and the drive pinions 124 sit in lubricating oil, eliminating the need for spray nozzles, distribution pumps, and flow or pressure sensors employed in various prior systems.

Figure 4:
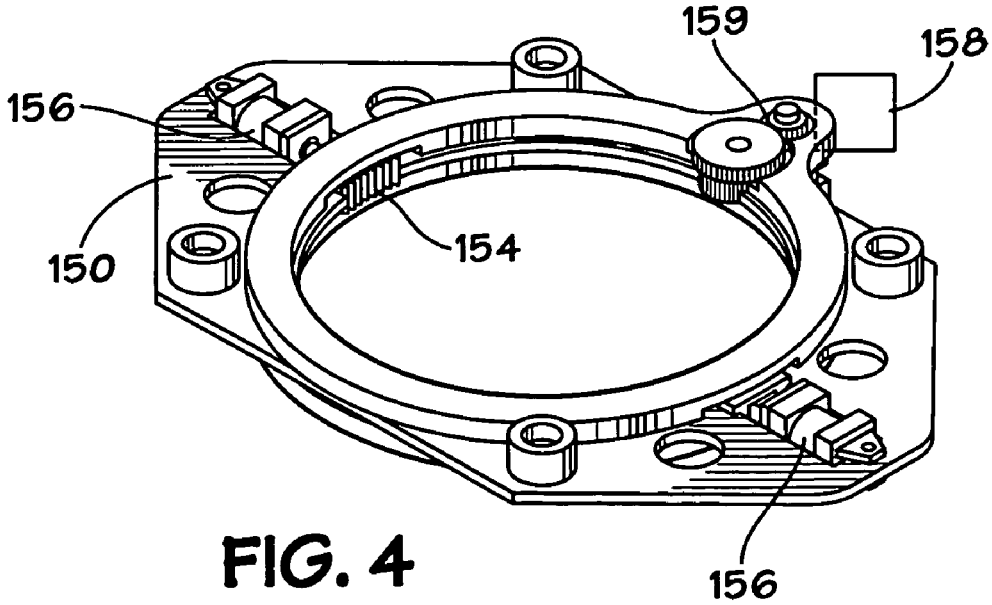
FIG. 4 is a perspective view of part of the top drive system of FIG. 2A.
Figure 3B:
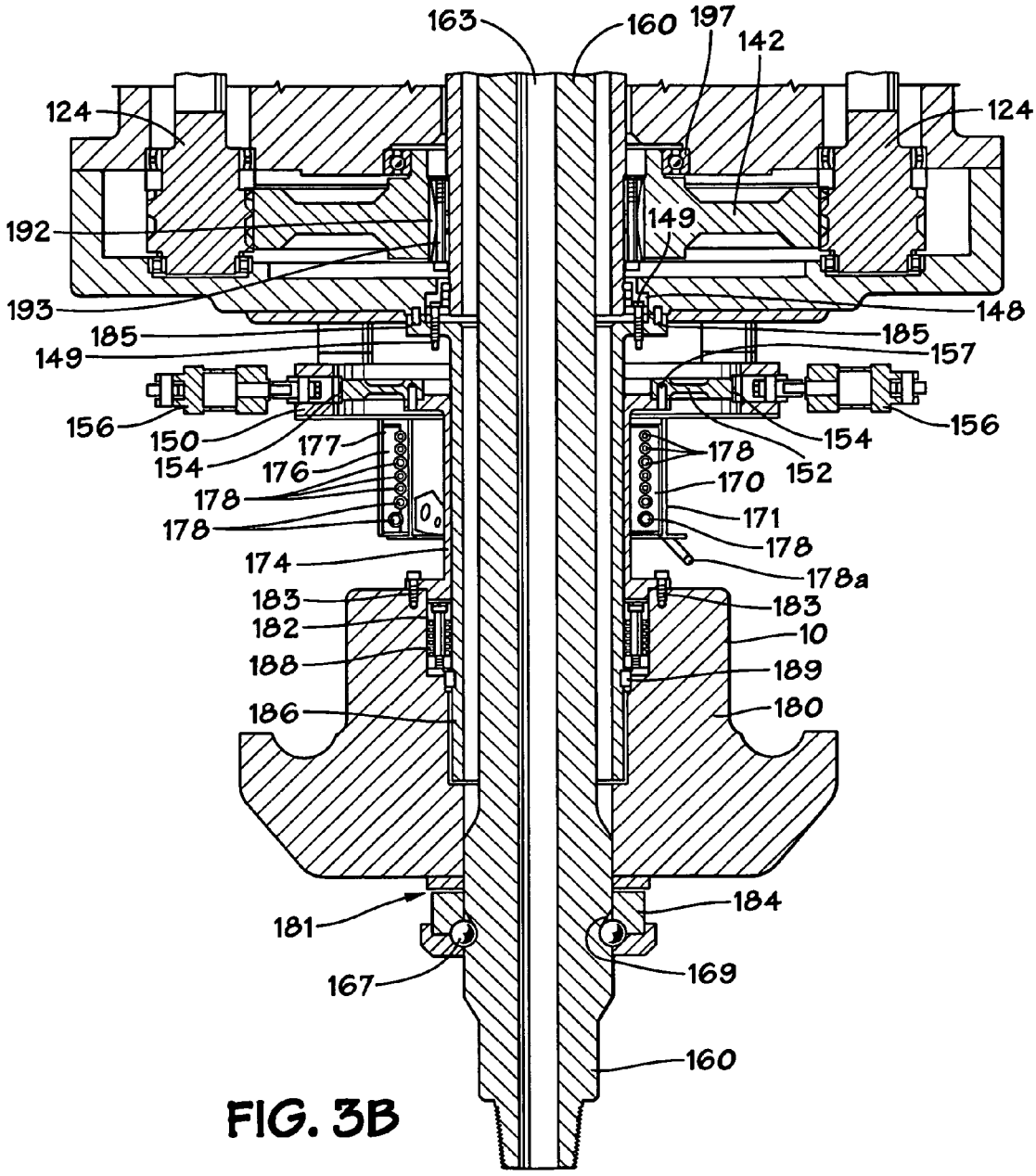
FIG. 3B is a cross-section view showing part of the top drive system of FIG. 3A.
Figure 3C:
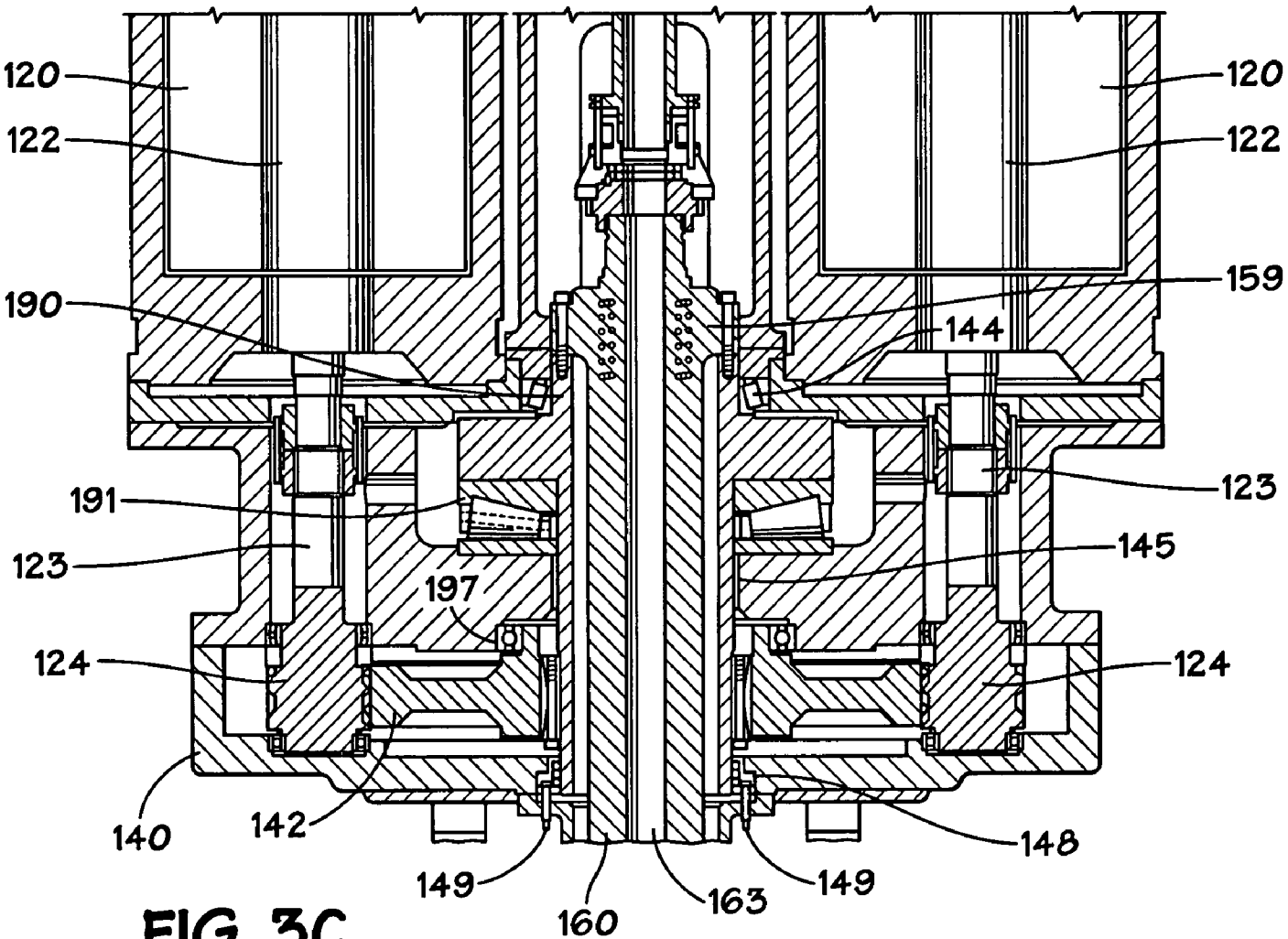
FIG. 3C is a cross-section view showing part of the top drive system of FIG. 3A.
Figure 3D:
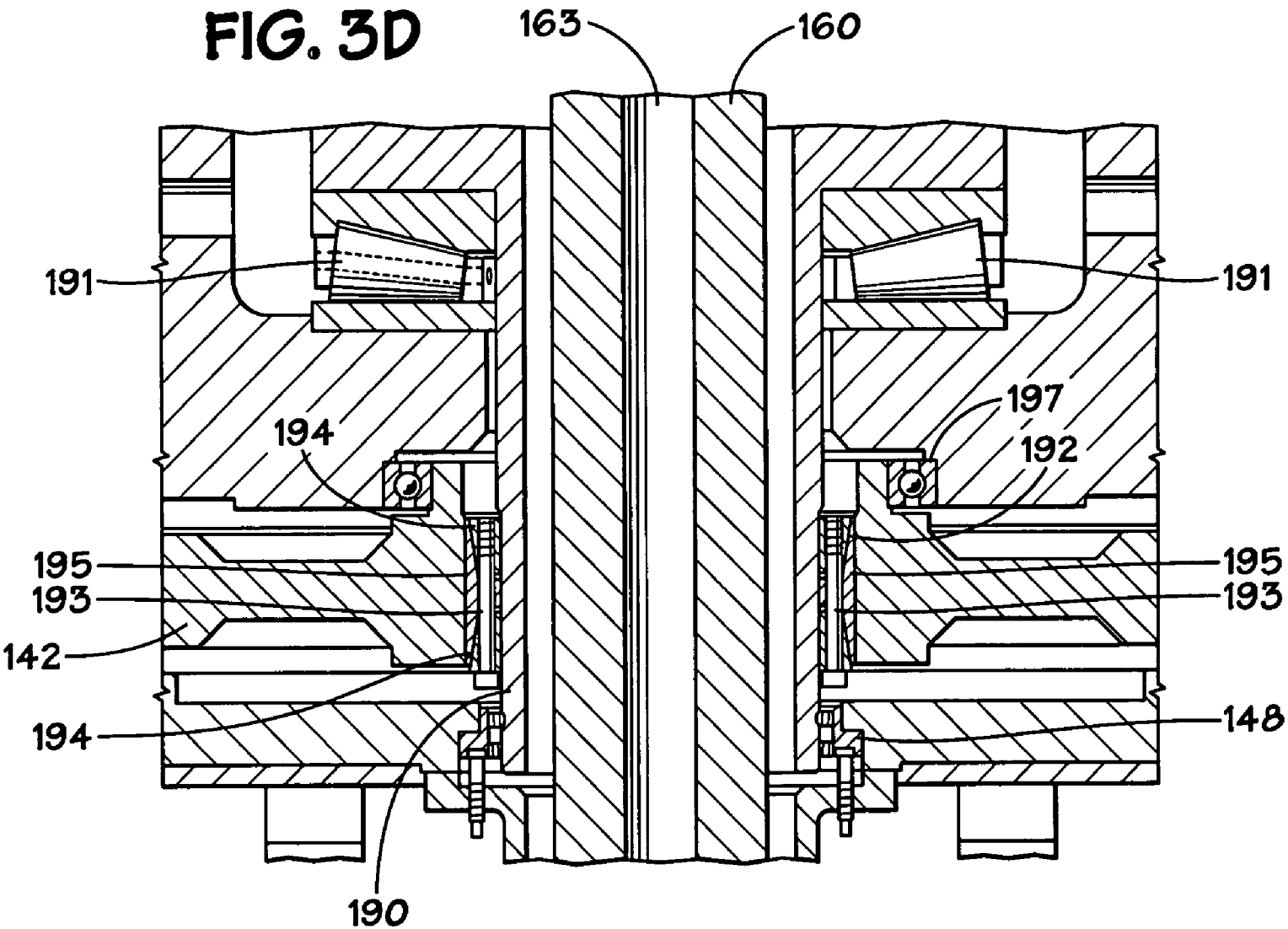
FIG. 3D is a cross-section view showing part of the top drive system of FIG. 3A.

The ring gear housing 150 which houses the ring gear 152 also has movably mounted therein two sector gears 154 each movable by a corresponding hydraulic cylinder apparatus 156 to lock the ring gear 152 (see, e.g., FIG. 3B and 4). With the ring gear 152 unlocked (with the sector gears 154 backed off from engagement with the ring gear 152), items below the ring gear housing 150 (e.g. a pipe handler on the link adapter) can rotate. The ring gear 152 can be locked by the sector gears 154 to act as a backup to react torque while drill pipe connections are being made to the drillstring. The ring gear 152 is locked when a pipe handler is held without rotation (e.g. when making a connection of a drill pipe joint to a drillstring). An hydraulic motor 158 (shown schematically), via gearing 159, turns the ring gear to, in turn, rotate the link adapter 180 and whatever is suspended from it; i.e., in certain aspects to permit the movement of a supported tubular to and from a storage area and/or to change the orientation of a suspended elevator, e.g. so that the elevator's opening throat is facing in a desired direction. Typical rig control systems are used to control the motor 158 and the apparatuses 156 and typical rig power systems provide power for them.

Figure 5:
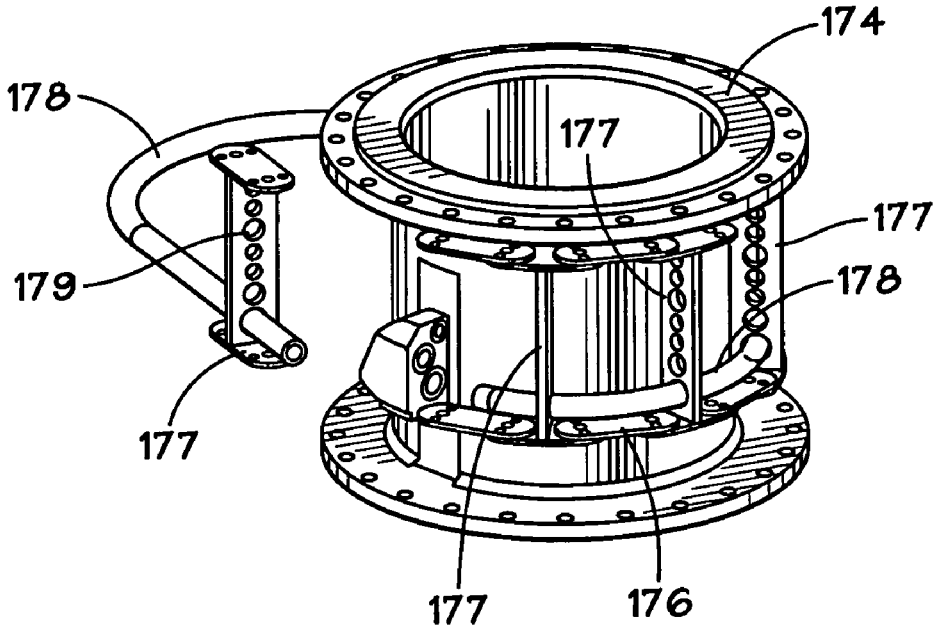
FIG. 5 is a perspective view of part of the top drive system of FIG. 2A.

In a variety of prior top drive systems a rotating head with a plurality of passageways therethrough is used between some upper and lower components of the system to convey hydraulic and pneumatic power used to control system components beneath the rotating head. Such a rotating head typically rotates through 360 degrees infinitely. Such a rotating head may, according to certain aspects of the present invention, be used with system according to the present invention; but, in other aspects, a drag chain system 170 is used below the ring gear housing 150 and above the link adapter 180 to convey fluids and signals to components below the ring gear housing 150 (see, e.g., FIGS. 3B and 5). The drag chain system 170 does not permit infinite 360 degree rotation, but it does allow a sufficient range of motion in a first direction or in a second opposite direction to accomplish all the functions to be achieved by system components suspended from the link adapter 180 (e.g. an elevator and/or a pipe handler), in one aspect with a range of rotative motion of about three-quarters of a turn total, 270 degrees.

Optionally, instead of a typical rotating head or a drag chain system according to the present invention, a variety of known signal/fluid conveying apparatuses may be used with systems according to the present invention; e.g., but not limited to, wireless systems or electric slip ring systems, in combination with simplified fluid slip ring systems.

Enclosed within a system housing 171 is a rotatable spool 174 which is rotated by a chain 176 made up of a plurality of interconnected chain sections 177. In one position the chain 176 is wound around the periphery of the spool 174. As the chain 176 unwinds from the spool 174 as the spool 174 is rotated by the hydraulic motor 158 rotating the ring gear 152, the unwinding chain portion feeds into the housing 171 in which it resides until the spool 174 is rotated in the opposite direction and the chain 176 is again wound onto the spool 174.

As the chain 176 winds and unwinds, hoses and cables 178 wind and unwind with the chain 176. Sections 177 of the chain 176 have openings 179 through which pass the hoses and cables 178 so that the chain 176 supports the hoses and cables 178 and maintains them in an organized, untangled arrangement with respect to the spool 174, both at rest and when the spool 174 is being rotated. One end of the chain 176 is secured to the spool 174. The hoses and cables 178 project out from the spool 174 and extend downwardly to components of the system (one such item illustrated in FIG. 3B as hose or cable 178*a*).

Fasteners 183 secure the spool 174 to the link adapter 180. The combination of the spool 174 and ring gear 152 (and, therefore, the link adapter 180 and whatever is suspended from it) is permitted some limited degree of vertical movement due to the dimensions of the ring gear housing 150 and the ring gear 152—the ring gear 152 can move up and down within the housing 150, e.g., in one particular aspect, about 0.25 inch, and the link adapter 180 can move a limited distance (a load ring/link adapter gap 181) with respect to a load ring 184 as described in detail below.

Figure 6:
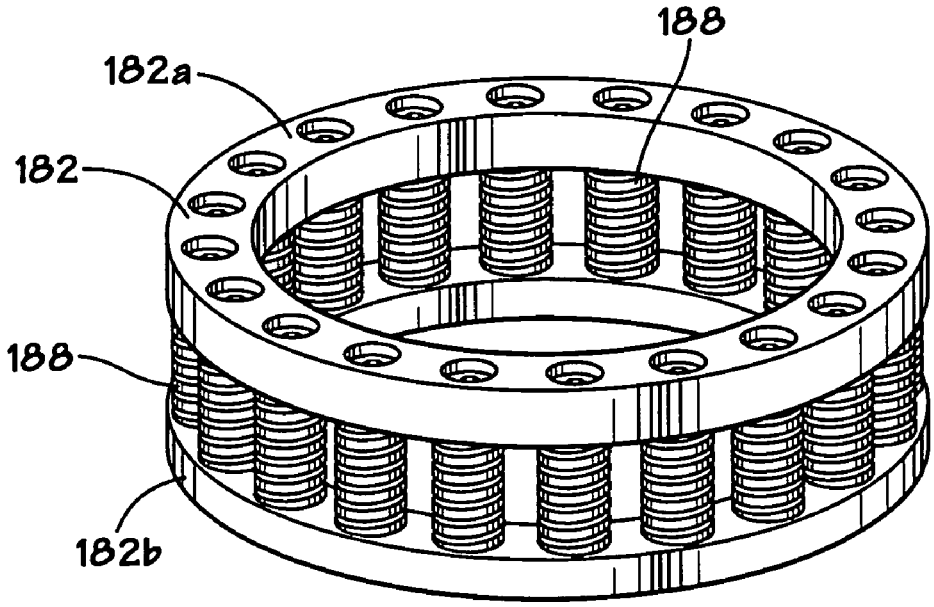
FIG. 6 is a perspective view of part of the top drive system of FIG. 2A.

A spring cartridge apparatus 182 with a top ring 182*a* and a bottom ring 182*b* has plurality of spaced-apart springs 188 which urge the two rings apart (see, e.g., FIGS. 3B and 6). The spring cartridge 182 is within the link adapter 180 and surrounds a stem 186 that is secured with bolts 185 to the gear housing 140. A ring 189 projecting into the wall of the stem 186 projects outwardly therefrom and supports the spring cartridge apparatus 182. The stem 186 acts as a guide for movement of the link adapter 180, maintains centering of the link adapter 180, and supports the link adapter 180, via the spring cartridge apparatus 182, during certain operations, e.g., drilling.

The springs 188 within the spring cartridge 182 push upwardly on the spool 174, lifting the spool 174 and maintain the gap 181 between the link adapter 180 and the load ring 184 (secured to the main shaft with a split ring 167); so that, e.g., during drilling, the main shaft 160 can rotate independently of the link adapter 180 and whatever is connected thereto. The springs 188 can support the weight of the link adapter, the links (or bails) connected to the link adapter, and an elevator apparatus. When tubular(s) are engaged by the elevator apparatus, the springs 188 collapse, the link adapter 180 moves down to rest on the load ring 184, the load then passes to and through the main shaft 160. Thus, the link adapter 180 (and whatever is connected thereto) can be maintained stationary while drilling. When a sufficient load is placed on the link adapter 180 (e.g. when hoisting the drillstring with an elevator or running casing), the forces of the springs 188 are overcome, the link adapter 180 is moved down to close the gap 181, and the link adapter 180 rests on the load ring 184 so that the link adapter load is transferred to the load ring 184.

Thus, certain systems according to the present invention provide two ways to transfer the load of tubular(s) supported by the system: first, the load of tubulars connected to the main shaft passes from the main shaft, to the quill, to the main thrust bearings, to the main body, to the bails, to the becket, to the hook and/or block, and to the derrick; and, secondly, when a string, e.g. a drillstring, is being raised or lowered without being rotated (e.g. when tripping pipe or lowering casing) the tubular load passes from a tubular support (e.g. an elevator) to the link adapter, to the load ring, to the split ring 167 and thence to the main shaft, and thence, as in the first load transfer path described above, to the derrick.

Drilling loads (the load of the drillstring, bit, etc.) passes through a threaded connection at the end of the main shaft 160 to the main shaft 160. Tripping loads (the load, e.g., of tubular(s) being hauled and manipulated) pass through the link adapter 180 and through the load ring 161, not through the threaded connection of the main shaft and not through any threaded connection so that threaded connections of the top drive are isolated from tripping loads.

In certain aspects as compared to certain prior system, the spring cartridge 182 with the plurality of springs 188 is a simpler, passive apparatus which requires relatively less maintenance and can result in reduced system downtime.

The main shaft can be removed from the system 100, to repair the main shaft or to replace the main shaft, without disturbing and without removing the gear case and gearing of the system. To remove the main shaft, the bonnet, gooseneck, washpipe, and associated packing are removed, preferably together as a unit. The bolts 164 that hold the main shaft down are removed. The split ring 167 is removed. The main shaft is disconnected from the quill. After the load ring and the split ring are removed, the main shaft is then removed from the system. During this removal process, all the system gearing and seals have remained in place and no lubricant has been removed or drained.

The present invention, therefore, provides in some, but not in necessarily all, embodiments a top drive system for wellbore operations, the top drive system including: a main body; a motor apparatus; a main shaft extending from the main body, the main shaft having a top end and a bottom end, the main shaft having a main shaft flow bore therethrough from top to bottom through which drilling fluid is flowable; a quill connected to and around the main shaft; a gear system interconnected with the quill, the gear system driven by the motor apparatus so that driving the gear system drives the quill and thereby drives the main shaft, the main shaft passing through the gear system; upper components connected to the main body above the top end of the main shaft; and the main shaft removable from the top drive system by disconnecting the main shaft from the quill, by disconnecting the upper components from the main body and moving the upper components from above the main shaft, and by lifting the main shaft from the quill.

The present invention, therefore, provides in some, but not in necessarily all, embodiments a top drive system for wellbore operations, the top drive system including: a main body; a motor apparatus; a main shaft extending from the main body, the main shaft having a top end and a bottom end, the main shaft having a main shaft flow bore therethrough from top to bottom through which drilling fluid is flowable; a quill connected to and around the main shaft; a gear system interconnected with the quill, the gear system driven by the motor apparatus so that driving the gear system drives the quill and thereby drives the main shaft, the main shaft passing through the gear system; a link adapter having a central bore therethrough, the main shaft passing through the central bore of the link adapter; a load ring connected to the main shaft; the link adapter positioned above the load ring; upper components connected to the main body above the top end of the main shaft; and the main shaft removable from the top drive system by disconnecting the main shaft from the quill, by disconnecting the load ring from the main shaft, by disconnecting the upper components from the main body, and by lifting the main shaft from the quill. Such a system may have one or some, in any possible combination, of the following: wherein the upper components include a bonnet connected to the main body, a washpipe in fluid communication with the top end of the main shaft, a gooseneck in fluid communication with the washpipe, and the upper components are movable from above the main shaft; wherein the gear system is in lubricant within an enclosed space and the main shaft is removable without lubricant draining from the enclosed space; wherein the quill is connected to the main shaft with first connectors through which tension on the main shaft is transferred to the quill, and with second connectors through which torque is transferred from the quill to the main shaft; two spaced-apart bails, each bail with two spaced-apart lower ends, and each lower end connected to the main body thereby providing a four-point connection between the bails and the main body for the bails to support the top drive system; a spring cartridge apparatus having a top ring, a bottom ring, a plurality of springs positioned between and urging apart the top ring and the bottom ring, the spring cartridge apparatus located within the link adapter and urging the link adapter away from the load ring so that a gap is maintained between the link adapter and the load ring until sufficient weight is supported by the link adapter to overcome the urging of the springs; a drag chain system for allowing rotation of the link adapter, the drag chain system including a housing, a spool rotatably mounted within the housing, a chain with a first end and a second end, the first end connected to the spool, the second end connected to the link adapter, the chain able to be wound onto and unwound from the spool, unwound chain received within the housing, a plurality of conduits carried by the chain, the conduits for transmitting signal or power fluids between the drag chain system and items below the link adapter, and a rotation system connected to the spool for rotating the spool and the link adapter; wherein the rotation system includes a ring gear housing, a ring gear rotatably mounted in the ring gear housing, a gearing system interconnected with the ring gear, a motor for driving the gearing system to rotate the ring gear to rotate the spool and the link adapter, winding and unwinding the chain as the link adapter is rotated; and/or wherein the rotation system includes locking apparatus for selectively preventing rotation of the ring gear thereby selectively preventing rotation of the link adapter.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes.

What is claimed is:

1. A top drive system for wellbore operations, the top drive system comprising a main body, a motor apparatus, a main shaft extending from the main body, the main shaft having a top end and a bottom end, the main shaft having a main shaft flow bore therethrough from top to bottom through which drilling fluid is flowable, a quill connected to and around the main shaft, a gear system interconnected with the quill, the gear system driven by the motor apparatus so that driving the gear system drives the quill and thereby drives the main shaft, the main shaft passing through the gear system, upper components connected to the main body above the top end of the main shaft, and the main shaft removable from the top drive system by disconnecting the main shaft from the quill, by disconnecting the upper components from the main body and moving the upper components from above the main shaft, and by lifting the main shaft from the quill.

2. The top drive system of claim 1 wherein the upper components include a bonnet connected to the main body, a washpipe in fluid communication with the top end of the main shaft, a gooseneck in fluid communication with the washpipe, and the upper components are movable from above the main shaft.

3. The top drive system of claim 1 wherein the gear system is in lubricant within an enclosed space and the main shaft is removable without lubricant draining from the enclosed space.

4. The top drive system of claim 1 wherein the quill is connected to the main shaft with first connectors through which tension on the main shaft is transferred to the quill, and with second connectors through which torque is transferred from the quill to the main shaft.

5. The top drive system of claim 1 further comprising two spaced-apart bails, each bail with two spaced-apart lower ends, and each lower end connected to the main body thereby providing a four-point connection between the bails and the main body for the bails to support the top drive system.

6. A top drive system for wellbore operations, the top drive system comprising a main body, a motor apparatus, a main shaft extending from the main body, the main shaft having a top end and a bottom end, the main shaft having a main shaft flow bore therethrough from top to bottom through which drilling fluid is flowable, a quill connected to and around the main shaft, a gear system interconnected with the quill, the gear system driven by the motor apparatus so that driving the gear system drives the quill and thereby drives the main shaft, the main shaft passing through the gear system, a link adapter having a central bore therethrough, the main shaft passing through the central bore of the link adapter, a load ring connected to the main shaft, the link adapter positioned above the load ring, upper components connected to the main body above the top end of the main shaft, and the main shaft removable from the top drive system by disconnecting the main shaft from the quill, by disconnecting the load ring from the main shaft, by disconnecting the upper components from the main body, and by lifting the main shaft from the quill.

7. The top drive system of claim 6 further comprising a spring cartridge apparatus having a top ring, a bottom ring, a plurality of springs positioned between and urging apart the top ring and the bottom ring, the spring cartridge apparatus located within the link adapter and urging the link adapter away from the load ring so that a gap is maintained between the link adapter and the load ring until sufficient weight is supported by the link adapter to overcome the urging of the springs.

8. The top drive system of claim 6 further comprising a drag chain system for allowing rotation of the link adapter, the drag chain system including a housing, a spool rotatably mounted within the housing, a chain with a first end and a second end, the first end connected to the spool, the second end connected to the link adapter, the chain able to be wound onto and unwound from the spool, unwound chain received within the housing, a plurality of conduits carried by the chain, the conduits for transmitting signal or power fluids between the drag chain system and items below the link adapter, and a rotation system connected to the spool for rotating the spool and the link adapter.

9. The top drive system of claim 8 wherein the rotation system includes a ring gear housing, a ring gear rotatably mounted in the ring gear housing, a gearing system interconnected with the ring gear, the motor apparatus including a motor for driving the gearing system to rotate the ring gear to rotate the spool and the link adapter, winding and unwinding the chain as the link adapter is rotated.

10. The top drive system of claim 9 wherein the rotation system includes locking apparatus for selectively preventing rotation of the ring gear thereby selectively preventing rotation of the link adapter.

11. A top drive system for wellbore operations, the top drive system comprising a main body, a motor apparatus, a main shaft extending from the main body, the main shaft having a top end and a bottom end, the main shaft having a main shaft flow bore therethrough from top to bottom through which drilling fluid is flowable, a quill connected to and around the main shaft, a gear system interconnected with the quill, the gear system driven by the motor apparatus so that driving the gear system drives the quill and thereby drives the main shaft, the main shaft passing through the gear system, a link adapter having a central bore therethrough, the main shaft passing through the central bore of the link adapter, a load ring connected to the main shaft, the link adapter positioned above the load ring, upper components connected to the main body above the top end of the main shaft, the main shaft removable from the top drive system by disconnecting the main shaft from the quill, by disconnecting the load ring from the main shaft, by disconnecting the upper components from the main body, and by lifting the main shaft from the quill, wherein the gear system is in lubricant within an enclosed space and the main shaft is removable without lubricant draining from the enclosed space, a drag chain system for allowing rotation of the link adapter, the drag chain system including a housing, a spool rotatably mounted within the housing, a chain with a first end and a second end, the first end connected to the spool, the second end connected to the link adapter, the chain able to be wound onto and unwound from the spool, unwound chain received within the housing, a plurality of conduits carried by the chain, the conduits for transmitting signal or power fluids between the drag chain system and items below the link adapter, and a rotation system connected to the spool for rotating the link adapter and the spool.

12. The top drive system of claim 11 wherein the quill is connected to the main shaft with first connectors through which tension on the main shaft is transferred to the quill, and with second connectors through which torque is transferred from the quill to the main shaft.

13. The top drive system of claim 11 further comprising two spaced-apart bails, each bail with two spaced-apart lower ends, each lower end connected to the main body thereby providing a four-point connection between the bails and the main body for the bails to support the top drive system.

14. A top drive system for wellbore operations, the top drive system comprising a main body, a motor apparatus, a main shaft extending from the main body, the main shaft having a top end and a bottom end, the main shaft having a main shaft flow bore therethrough from top to bottom through which drilling fluid is flowable, a quill connected to and around the main shaft, a gear system interconnected with the quill, the gear system driven by the motor apparatus so that driving the gear system drives the quill and thereby drives the main shaft, the main shaft passing through the gear system, a link adapter having a central bore therethrough, the main shaft passing through the central bore of the link adapter, a load ring connected to the main shaft, the link adapter positioned above the load ring, upper components connected to the main body above the top end of the main shaft, the main shaft removable from the top drive system by disconnecting the main shaft from the quill, by disconnecting the load ring from the main shaft, by disconnecting the upper components from the main body, and by lifting the main shaft from the quill, wherein the upper components include a bonnet connected to the main body, a washpipe in fluid communication with the top end of the main shaft, a gooseneck in fluid communication with the washpipe, the upper components are movable from above the main shaft, wherein the quill is connected to the main shaft with first connectors through which tension on the main shaft is transferred to the quill, and with second connectors through which torque is transferred from the quill to the main shaft.

15. The top drive system of claim 14 wherein the gear system is in lubricant within an enclosed space and the main shaft is removable without lubricant draining from the enclosed space.

16. The top drive system of claim 14 further comprising two spaced-apart bails, each bail with two spaced-apart lower ends, each lower end connected to the main body thereby providing a four-point connection between the bails and the main body for the bails to support the top drive system.

17. The top drive system of claim 14 further comprising a drag chain system for allowing rotation of the link adapter, the drag chain system including a housing, a spool rotatably mounted within the housing, a chain with a first end and a second end, the first end connected to the spool, the second end connected to the link adapter, the chain able to be wound onto and unwound from the spool, unwound chain received within the housing, a plurality of conduits carried by the chain, the conduits for transmitting signal or power fluids between the drag chain system and items below the link adapter, and a rotation system connected to the spool for rotating the link adapter and the spool.

18. The top drive system of claim 14 further comprising a spring cartridge apparatus having a top ring, a bottom ring, a plurality of springs positioned between and urging apart the top ring and the bottom ring, the spring cartridge apparatus located within the link adapter and urging the link adapter away from the load ring so that a gap is maintained between the link adapter and the load ring until sufficient weight is supported by the link adapter to overcome the urging of the springs.

19. A method for removing a main shaft from a top drive system, the method comprising disconnecting the main shaft from a quill of the top drive system, the top drive system comprising a main body, a motor apparatus, a main shaft extending from the main body, the main shaft having a top end and a bottom end, the main shaft having a main shaft flow bore therethrough from top to bottom through which drilling fluid is flowable, a quill connected to and around the main shaft, a gear system interconnected with the quill, the gear system driven by the motor apparatus so that driving the gear system drives the quill and thereby drives the main shaft, the main shaft passing through the gear system, upper components connected to the main body above the top end of the main shaft, and the main shaft removable from the top drive system, disconnecting the upper components from the main body, moving the upper components from above the main-shaft, and lifting the main shaft from the quill.

20. The method of claim 19 wherein the gear system is in lubricant within an enclosed space and the main shaft is removable without lubricant draining from the enclosed space.

* * * * *